US011324272B2

(12) United States Patent
Hoshizaki

(10) Patent No.: US 11,324,272 B2
(45) Date of Patent: May 10, 2022

(54) HELMET WITH SHEAR FORCE MANAGEMENT

(71) Applicant: MIPS AB, Täby (SE)

(72) Inventor: Thomas Blaine Hoshizaki, Rockcliffe Park (CA)

(73) Assignee: MIPS AB

( * ) Notice: Subject to any disclaimer, the term of this patent is extended or adjusted under 35 U.S.C. 154(b) by 246 days.

(21) Appl. No.: 16/468,932

(22) PCT Filed: Dec. 12, 2017

(86) PCT No.: PCT/CA2017/051507
§ 371 (c)(1),
(2) Date: Jun. 12, 2019

(87) PCT Pub. No.: WO2018/107286
PCT Pub. Date: Jun. 21, 2018

(65) Prior Publication Data

US 2019/0335838 A1 Nov. 7, 2019

Related U.S. Application Data

(60) Provisional application No. 62/433,551, filed on Dec. 13, 2016.

(51) Int. Cl.
*A42B 3/12* (2006.01)
*A42B 3/06* (2006.01)

(52) U.S. Cl.
CPC ..... *A42B 3/121* (2013.01); *A42B 3/064* (2013.01); *A42B 3/125* (2013.01)

(58) Field of Classification Search
CPC ..... A42B 3/121; A42B 3/064; A42B 3/125; A42B 3/063; A42B 3/12; A42B 3/128;
(Continued)

(56) References Cited

U.S. PATENT DOCUMENTS 3,494,607 A * 2/1970 Rusch ..... B60R 19/18 267/116
3,849,801 A 11/1974 Holt et al.
(Continued)

FOREIGN PATENT DOCUMENTS

CA 2936088 A1 7/2014
CN 104219975 A 12/2014
(Continued)

*Primary Examiner* — Amy Vanatta
(74) *Attorney, Agent, or Firm* — Perkins Coie LLP

(57) ABSTRACT

The present disclosure relates to a cushion for use in a helmet comprising an outer shell for impact with an incoming force, the cushion disposed between the outer shell and a head when the helmet is worn, the cushion comprising: a sealed bladder comprising a flexible membrane; a pad housed within the bladder, said pad comprising a compressible member having interstices open to the exterior of the pad; and a liquid within the interior of the bladder; wherein said pad absorbs at least some of said liquid when uncompressed and expels said liquid when compressed; and wherein the volume of liquid within the bladder is sufficient to allow opposing surfaces of the bladder to be displaced in a shearing motion relative to each other when the cushion is compressed and subjected to shear forces, to decouple shear forces between said helmet and the head.

19 Claims, 17 Drawing Sheets

(58) Field of Classification Search
CPC .. A41D 13/015; A41D 13/05–13/0543; A41D 13/06–13/088; A41D 19/01523; A41D 31/285; A41D 31/28; F16F 9/006; F16F 9/30; F16F 9/306; F16F 13/00; F16F 2224/041; F16F 13/04; F16F 2224/0225; A63B 71/081; A63B 71/10
USPC ..... 2/413
See application file for complete search history.

(56) References Cited

U.S. PATENT DOCUMENTS 4,853,980 A 8/1989 Zarotti
5,330,249 A * 7/1994 Weber ..... A41D 19/01523 2/161.1
5,545,128 A * 8/1996 Hayes ..... A41D 13/0156 602/61
5,599,290 A * 2/1997 Hayes ..... A41D 13/0156 602/61
5,815,846 A * 10/1998 Calonge ..... A42B 3/121 2/413
6,127,010 A 10/2000 Rudy
6,485,446 B1 * 11/2002 Brother ..... A41D 13/06 2/455
6,701,529 B1 * 3/2004 Rhoades ..... C08L 83/16 2/2.5
7,299,505 B2 * 11/2007 Dennis ..... A42B 3/12 2/410
8,091,692 B2 * 1/2012 Deshmukh ..... F16F 9/003 188/267.2
8,171,585 B2 * 5/2012 Mead ..... A41D 31/28 5/655.4
8,524,338 B2 9/2013 Anderson et al.
8,679,047 B2 * 3/2014 Holt ..... A41D 13/0543 602/60
8,716,967 B2 5/2014 Okumura
8,844,066 B1 * 9/2014 Whitcomb ..... A42B 3/08 2/413
9,486,029 B2 * 11/2016 Galaitsis ..... A42B 3/122
2003/0005549 A1 * 1/2003 DeLuca ..... A47C 7/40 16/430
2005/0037189 A1 * 2/2005 Palmer ..... F16F 7/00 428/304.4
2006/0234572 A1 * 10/2006 Wagner ..... C08L 71/02 442/59
2008/0263772 A1 * 10/2008 Chiu ..... A47C 4/54 5/654
2010/0086747 A1 * 4/2010 Plant ..... A41D 31/285 428/188
2010/0315703 A1 * 12/2010 Purdy ..... G02B 1/005 359/350
2012/0186003 A1 * 7/2012 Heger ..... F16F 9/53 2/412
2012/0297526 A1 * 11/2012 Leon ..... A63B 71/10 2/413
2014/0259326 A1 * 9/2014 Carlson ..... A41D 13/015 2/455
2015/0033453 A1 * 2/2015 Pannikottu ..... B32B 5/18 2/413
2015/0126631 A1 * 5/2015 Bruno ..... A42B 3/125 521/54
2015/0272255 A1 * 10/2015 Galaitsis ..... A42B 3/121 2/413
2018/0153245 A1 * 6/2018 Pannikottu ..... A63B 71/081
2018/0264718 A1 * 9/2018 McCluskey ..... B33Y 40/00
2020/0221804 A1 * 7/2020 Morgan ..... A42B 1/008

FOREIGN PATENT DOCUMENTS

CN 104244754 A 12/2014
WO 2012148582 A2 11/2012

* cited by examiner

HELMET WITH SHEAR FORCE MANAGEMENT

CROSS REFERENCE TO RELATED APPLICATION

This application is a 35 USC § 371 National Stage application of International Application No. PCT/CA2017/051507, entitled "HELMET WITH SHEAR FORCE MANAGEMENT," filed on Dec. 12, 2017, which claims priority to United States provisional application No. 62/433,551, filed Dec. 13, 2016, which is incorporated herein by reference.

FIELD

The present disclosure relates to body impact protection equipment such as helmets, and in particular to a helmet having the ability to manage shear and rotational forces when impacted.

BACKGROUND

The primary purpose of a helmet is to protect the user's head from injury. A helmet typically includes a hard outer shell and an energy absorbing liner. The outer shell is designed to distribute forces in order to engage a greater volume of the energy absorbing liner. The liner usually comprises a compressible material that absorbs impact energy by distorting and absorbing the impact using the resilient and/or compressible properties of the material or by crushing and absorbing energy by material fracture.

Head injuries typically result from linear and/or rotational forces acting on the head. Certain types of head injuries such as skull fractures and intracranial bleeds usually arise from linear accelerations. Injuries such as concussions and subdural hematomas are thought to arise from rotational accelerations. Conventional helmets are primarily designed to manage linear forces and are less effective at managing shear or rotational forces. This has resulted in successful mitigation of injuries associated with linear forces such as skull fractures and intracranial hemorrhaging, but less success in reducing injuries such as concussions that are more closely associated with rotational or shear forces.

Various solutions intended to manage rotational motions have been developed and proposed, such as providing a slippery surface material to cover the helmet thereby decreasing friction between the surface of the helmet and the impacting object. Other solutions include the use of low friction layer between the helmet shell and an inner head-gripping member, or a layer that consists of a gel, liquid or other soft material between the shell and liner, or other layers of materials, to allow the outer shell to rotate and/or slide horizontally independent of the liner or the user's head.

Similar principles apply to body armor used for protecting other areas, but particularly serious injuries are often to the head.

SUMMARY

A drawback of at least some conventional solutions that permit independent rotation of the helmet shell is added weight which increases fatigue and can also increase the moment of inertia of the helmet, as well as other drawbacks.

We disclose a body armor system such as a helmet that includes an energy absorbing layer or a shell, and a cushion for installed within the inside (body facing) side thereof. The cushion consists of a bladder comprising a flexible, liquid-filled membrane which houses a compressible and resilient pad.

In one embodiment, the pad has pores or other interstices that are open to the exterior of the pad (such as open cell foam) to permit the liquid to be secreted and absorbed by the pad when the pad is compressed and decompressed. Before an impact occurs, the pad is in an expanded position whereby the liquid is fully or substantially absorbed within the pad and the pad is at least partially saturated. On impact, the pad is compressed. This in turn squeezes the liquid from the pad, which then forms a liquid layer within the bladder around the pad, which in turn increases the ability of the pad to manage shear forces. When the pressure is then released from the cushion, the pad returns to its expanded, saturated status wherein it is more resistant to shear. This combination of properties permits the helmet to remain comfortably seated on the user's head during normal use, without undue rotation, but to have increased rotational freedom when the helmet is impacted.

The presence of free-flowing liquid within the bladder when compressed permits opposing surfaces of the bladder to be displaced in a shearing motion relative to each other, effectively permitting the bladder to "roll", when the cushion is subjected to a shear force. This allows the cushion to decouple at least a portion of the shear forces that arise between the shell and the user's body when the equipment is subjected to an obliquely-directed impact.

The cushion provides a combination of some or all of the following:

a) The liquid-filled bladder is less compressive than a conventional foam pad and thus provides improved impact protection to attenuate linear (radial) forces.

b) Prior to receiving an impact, the liquid within the cushion is absorbed and/or displaced within the bladder, thereby minimizing rotational movement of the cushion. This improves user comfort and stabilizes the helmet during use.

c) Upon receiving an oblique impact, the liquid within the bladder permits opposing sides of the bladder to slip relative to each other, thereby allowing the shell of the helmet to move laterally relative to the user's head. This permits the helmet to rotate upon impact to attenuate rotational/shear forces imparted to the head. This result occurs because the liquid layer within the cushion creates a slip plane which shifts freely under a shear-type force.

In one aspect, we disclose a cushion for installation between opposing layers, comprising:

- a sealed bladder comprising a flexible membrane;
- a pad housed within the bladder, said pad comprising a compressible member having interstices open to the exterior of the pad; and
- a liquid within the interior of the bladder;
- wherein said pad absorbs at least some of said liquid when uncompressed and expels said liquid when compressed; and
- wherein the volume of liquid within the bladder is sufficient to allow opposing surfaces of the bladder to be displaced in a shearing motion relative to each other when the cushion is compressed and subjected to shear forces, to decouple shear forces between said opposing layers.

According to an aspect, the bladder comprises an elastomeric material such as thermoplastic polyurethane (TPU) or polyvinyl chloride (PVC). The liquid may comprise an oil or a gel. The pad may comprise an open cell foam such as a vinyl nitrile foam or may comprise a closed cell foam.

We further disclose a helmet comprising an outer shell and/or an energy absorbing layer such as rigid foam and an array of cushions as described herein mounted against the user's head.

We further disclose a method of attenuating the impact energy from an incoming force to decrease trauma to a body part, the method comprising using a body protection system such as a helmet that includes and outer shell and/or energy absorbing layer and an array of cushions as described herein mounted against the user. Upon receiving an oblique impact, shear forces are generated between the shell or energy absorbing layer and the user which are managed and attenuated by the cushions.

In one embodiment, we disclose a body armor system comprising an outer impact-receiving layer and an at least one cushion interior to said layer for managing shear forces impacting the outer impact-receiving layer, said cushion comprising a sealed flexible bladder filled with a liquid and containing a compressible and resilient solid element therein, wherein the solid element is configured to permit the liquid to flow at least partially around the element.

In one embodiment, we disclose a cushion for managing shear forces in a body armor, the cushion comprising a sealed flexible bladder filled with a liquid and containing a compressible and resilient solid element therein, wherein the solid element is detached from at least an upper or lower surface of the bladder to permit the liquid to flow at least partially around the element.

Unless otherwise specified, directional references herein refer to the helmet and head in an upright position. Furthermore, the detailed description herein is only intended to provide examples and representative embodiments of the invention and is not intended to limit the scope of the invention. The full scope of the invention is presented in the specification as a whole.

DETAILED DESCRIPTION

Figure 1:
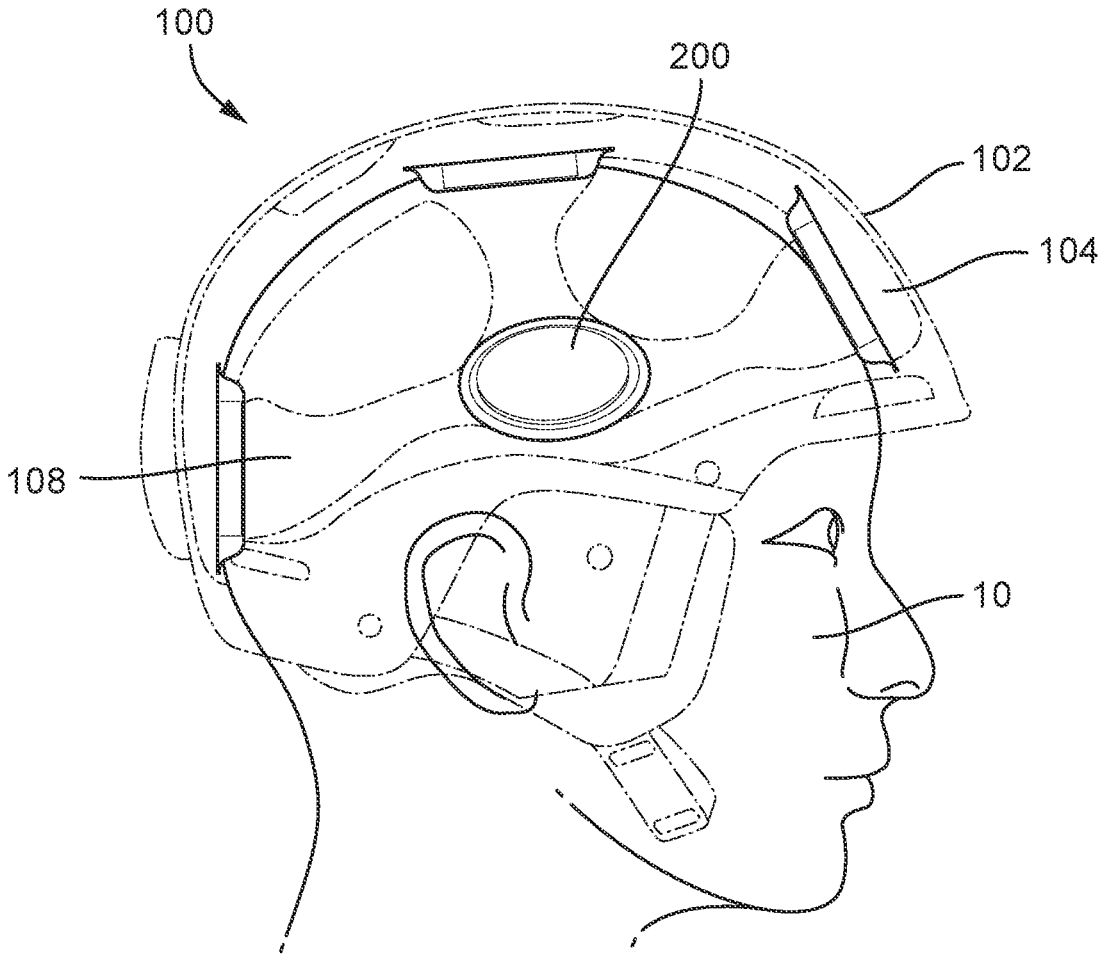
FIG. 1 is a side elevational view of a helmet, in partial transparency to show the internal structure, including energy-absorbing cushions attached to the helmet shell.

Shown in FIG. 1 is a helmet 100 for protecting a user's head 10. Helmet 100 may be configured for essentially any activity in which a wearer may be subject to impact, including contact sports such as football and hockey, bicycling, motorcycling and other motor sports, climbing, equestrian, snow sports and work helmets.

Helmet 100 includes an outer shell 102 which is normally (but not necessarily) relatively rigid and may comprise polycarbonate, polyethylene or other suitable material. The shell material and its thickness and other parameters will depend on the functional requirements of the intended use. For example, the shell of a snow sports or downhill cycling helmet may comprise a relatively thick and rigid fiberglass or carbon fiber layer, while a road cycling helmet shell may comprise a thin, somewhat flexible material. Outer shell 102 may be intended for disposal after a single hard impact or for withstanding repeated impacts.

Shell 102 has an inner layer or liner 104 for absorbing energy. Liner 104 may comprise a compressible material such as vinyl nitrile, polystyrene (EPS) or polypropylene (EPP) foam. Liner 104 may substantially line the entire interior surface of shell 102 or alternatively may have windows or other gaps in the structure.

An array of cushions 200 is installed inside shell 102. Cushions 102 may be attached directly to shell 102 whereby they are located between shell 102 and liner 104 or alternatively, cushions 200 may be attached to the inside surface of liner 104 to more directly contact the user's head 10. A further innermost liner such as a thin fabric or mesh material may be provided for user comfort.

Figure 2:
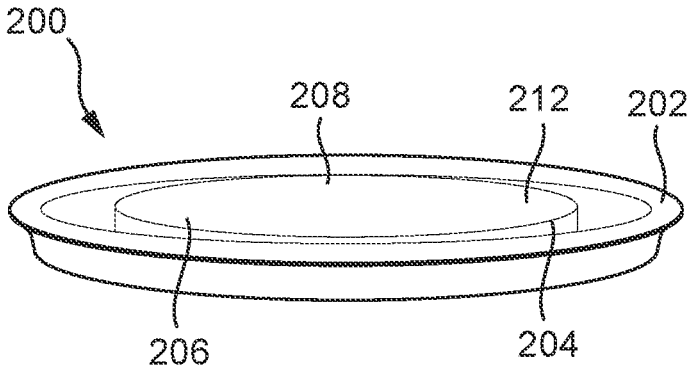
FIG. 2 is a perspective view of a cushion according to an embodiment of the invention.
Figure 3:
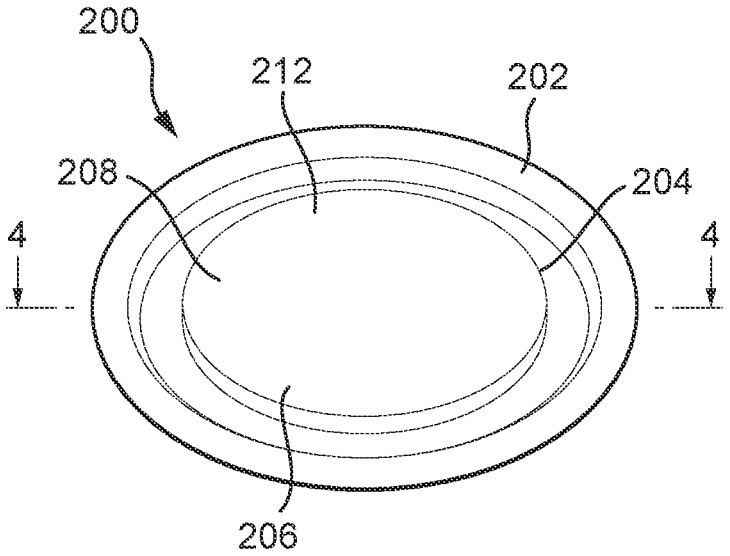
FIG. 3 is a top plan view of the cushion of FIG. 2.
Figure 4:
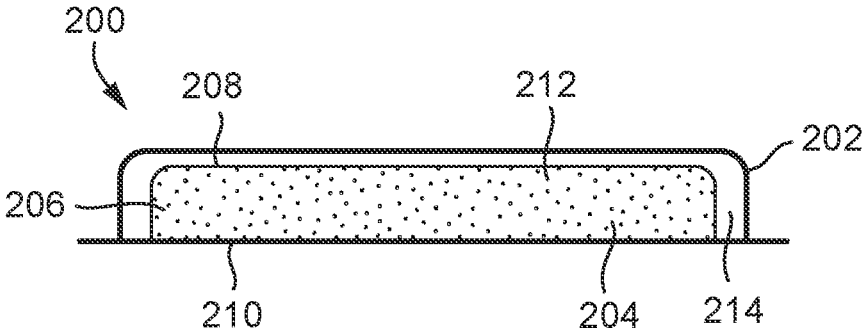
FIG. 4 a sectional view along line 4-4 of FIG. 3.

As shown in FIGS. 2 to 4, cushion 200 comprises a bladder 202 housing a liquid 204 and a compressible pad 206. Bladder 202 forms a sealed envelope that comprises a sheet of highly flexible material. Examples include thermoplastic elastomeric material, such as thermoplastic polyurethane (TPU) or polyvinyl chloride (PVC). The TPU may have a shore hardness of about 85A. Bladder 202 should be sufficiently robust to minimize the risk of puncture or other leakage over a wide range of conditions such as temperature fluctuations, compression during normal use and upon impact, exposure to various substances, etc. In order to seal bladder 202, its edges are welded or otherwise sealed in a robust fashion, as is known in the art. For example, the edges of bladder 202 can be sealed using an adhesive to form a flange 203.

Liquid 204 can be oil, a gel or an aqueous liquid that remains in the liquid phase over a wide range of ambient temperature conditions. Suitable examples include oils, preferably a low viscosity oil such as vegetable or mineral oil. A suitable mineral oil is crystal plus oil, which is an odorless, tasteless, crystal clear, food-grade white mineral oil.

Figure 5:
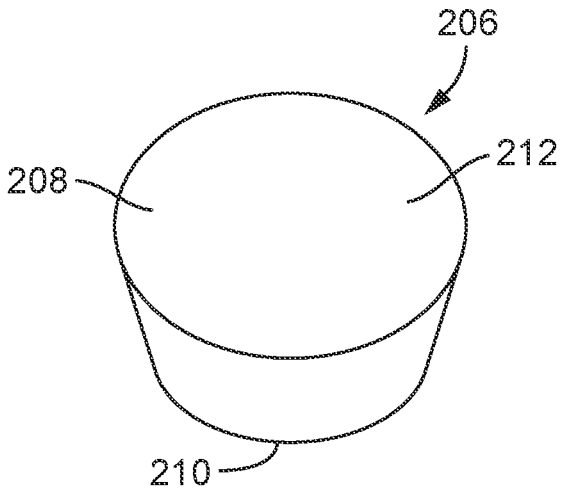
FIG. 5 is a perspective view of an internal pad component of the cushion.

Referring to FIG. 5, pad 206 is a solid element and comprises a generally flat, disk or puck-like configuration having opposing upper and lower surfaces 208 and 210. As discussed below, pad 206 may comprise other configurations.

According to one example, pad 206 is fabricated from a resilient, compressible material, such as open cell foam which may have a shore 00 hardness of about 20. The open structure of pad 206 is provided by pores 212 or other interstices for absorbing liquid 204, which and allow pad 206 to sequentially absorb and squeeze out liquid 204 when expanded and compressed, respectively. Pad 206 is highly compressible whereby it can be easily compressed to a small percentage of its original thickness. Suitable open cell foam materials have relatively low density, firm support, good durability, good shock absorption and vibration dampening, and resistance against degradation by exposure to the selected liquid 204. Examples include open cell vinyl nitrile or polyurethane foam. Other suitable foams include K329 or similar low density foams.

Figure 6:
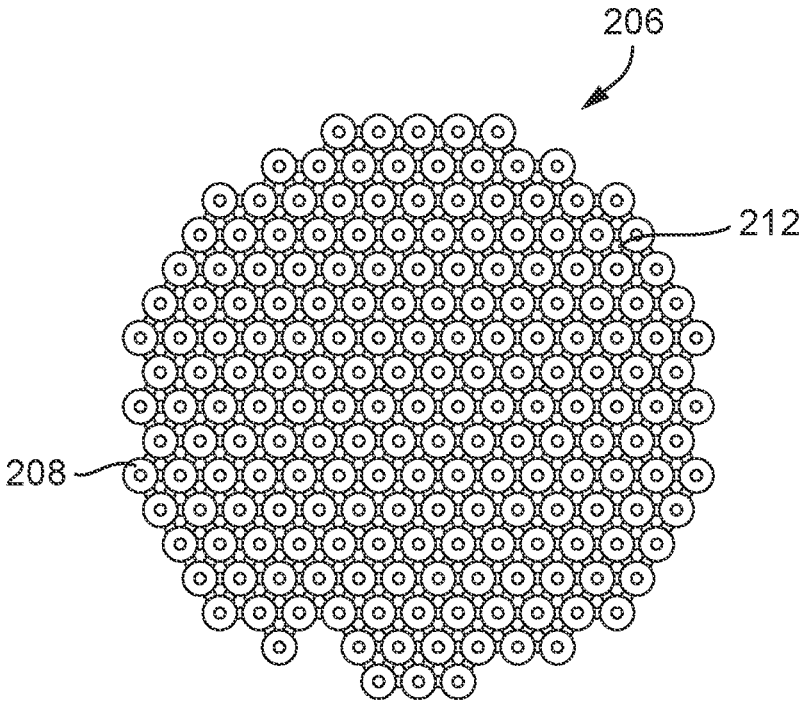
FIG. 6 is a top plan view of the pad according to a further embodiment.

In another example, pad 206 comprises a compressible lattice structure, for example a structure formed from beads or other units fused together, in which the beads can individually compress or distort. This structure has interstices between the beads that alternately retain and expel liquid as the structure is decompressed and compressed. For example, as shown in FIG. 6, pad 206 may comprise a lattice-like structure that is compressible to absorb or expel liquid from the interstices/pores 212 between solid members. A structure of this type can absorb a large quantity of liquid whilst being lightweight and also capable of rapid compression and expansion. The thickness, shape and, type of material of pad 206 can be adjusted based on desired levels of liquid absorption characteristics and impact attenuation characteristics.

In an alternative example, pad 206 may comprise a closed cell foam such as ethylene-vinyl acetate (EVA) foam, or a composite of open and closed cell components.

Figure 7A:
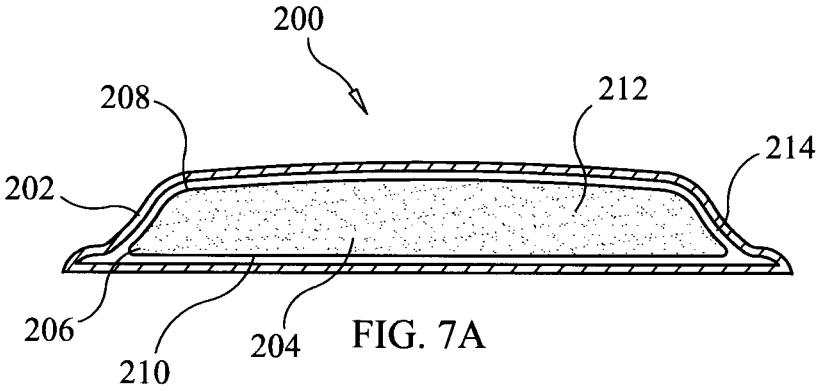
FIGS. 7*a*, 7*b*, and 7*c* show cross sectional views along line 4-4 of FIG. 3, showing the cushion subjected to various impacts.

As shown in FIG. 7*a*, pad 206 substantially fills the interior of bladder 202 when uncompressed. Pad 206 may be fully detached from bladder 202 whereby it is free-floating within bladder 202 or alternatively at least one of an upper or lower surface 208 or 210 of pad 206 may be attached to bladder 202. A gap 214 exists between one or both of sides 208/210 of pad 206 and the corresponding inside surface of bladder 202. Gap 214 permits sufficient liquid 204 to be present between pad 206 and bladder 202 to permit slippage to easily occur between these components when subjected to shear forces; it will be appreciated that this gap 214 may be very small to still permit such movement. Gap 214 can range from slightly above zero to up to about 1 mm, or between about 1 mm and about 3 mm.

Pad 206 is normally uncompressed or only lightly compressed when helmet 100 is worn during normal use, prior to any impact thereon. The term "uncompressed" as used herein includes, unless otherwise stated, a small amount of compression that might occur during such normal wearing of the helmet. In this state, at least a portion and preferably most of liquid is absorbed within pad 206. Pad 206 may be substantially saturated with liquid 204 whereby an impact on helmet 100 quickly releases a substantial portion of liquid 204 from pad 206, whereby liquid 204 is then free-flowing within bladder 202.

As used herein, the terms "absorption" and similar terms refer to the property of pad 206 to draw in and retain liquid 204 within pores 212 in a reversible fashion in a physical process.

Figure 7B:
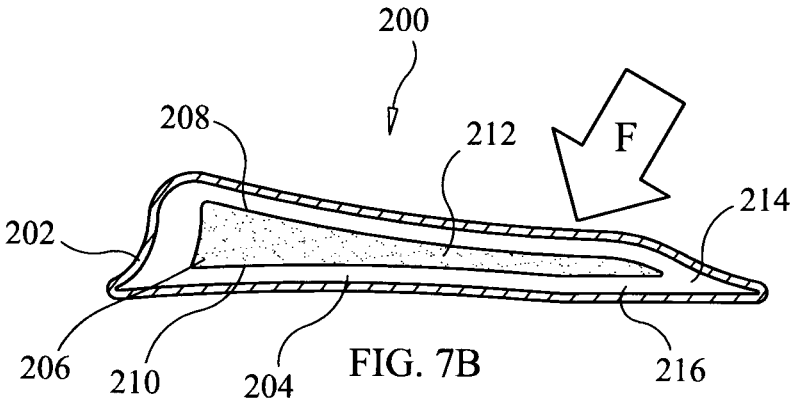
Figure 7C:
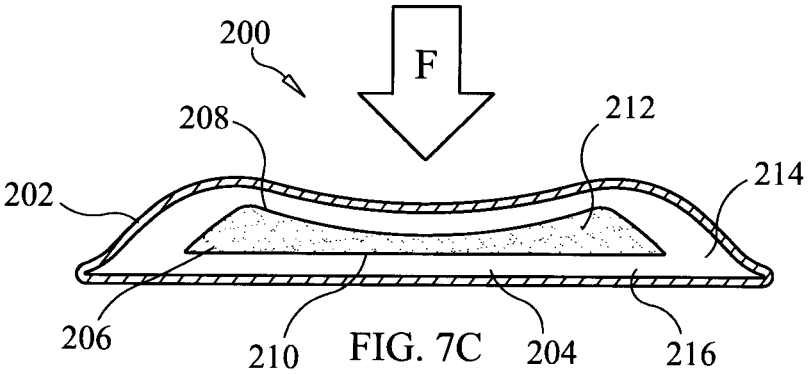
Figure 8A:
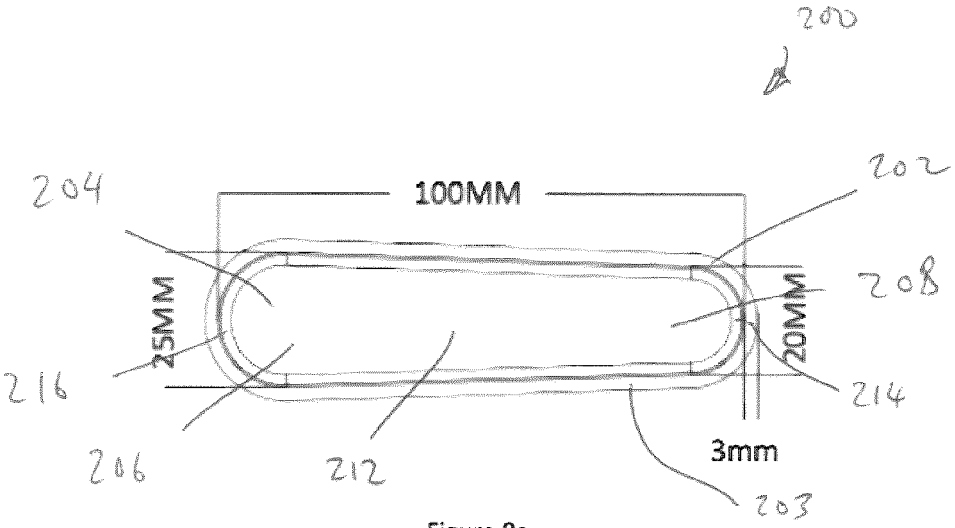
FIGS. 8*a* to 8*h* show top plan views of various embodiments of the cushions.
Figure 8B:
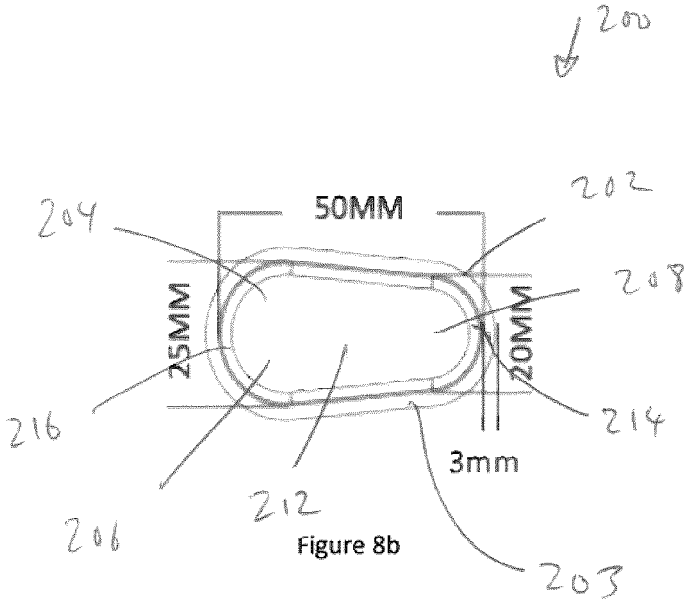
Figure 8C:
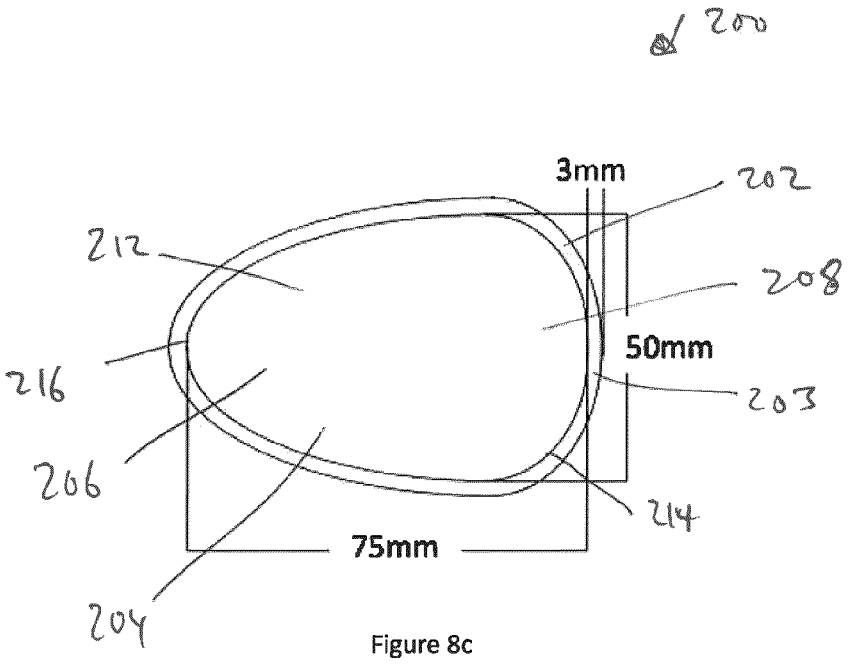
Figure 8D:
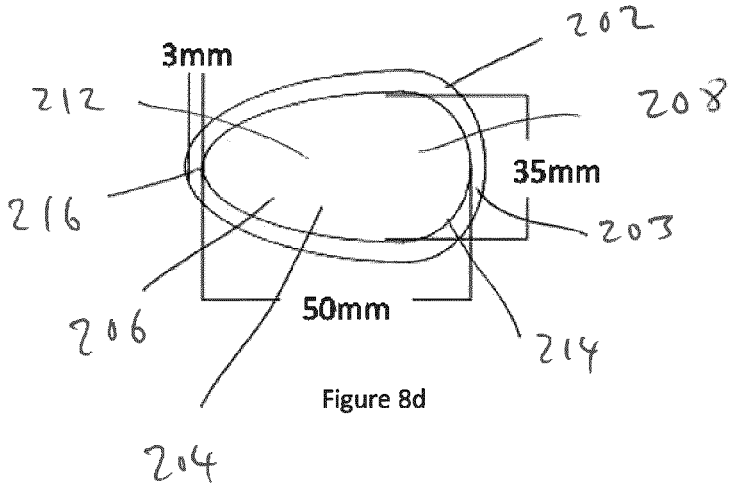
Figure 8E:
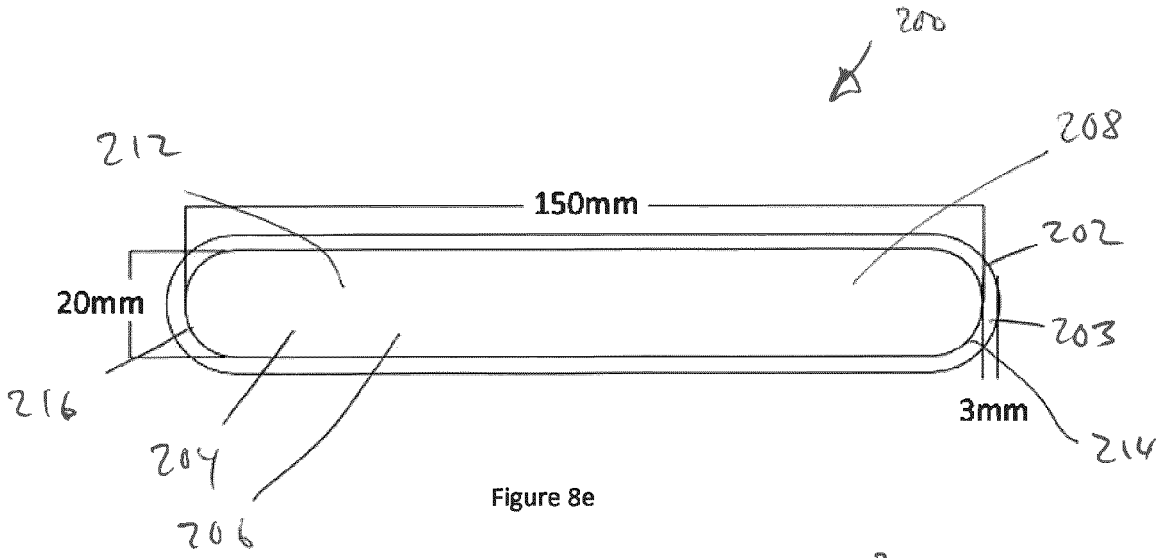
Figure 8F:
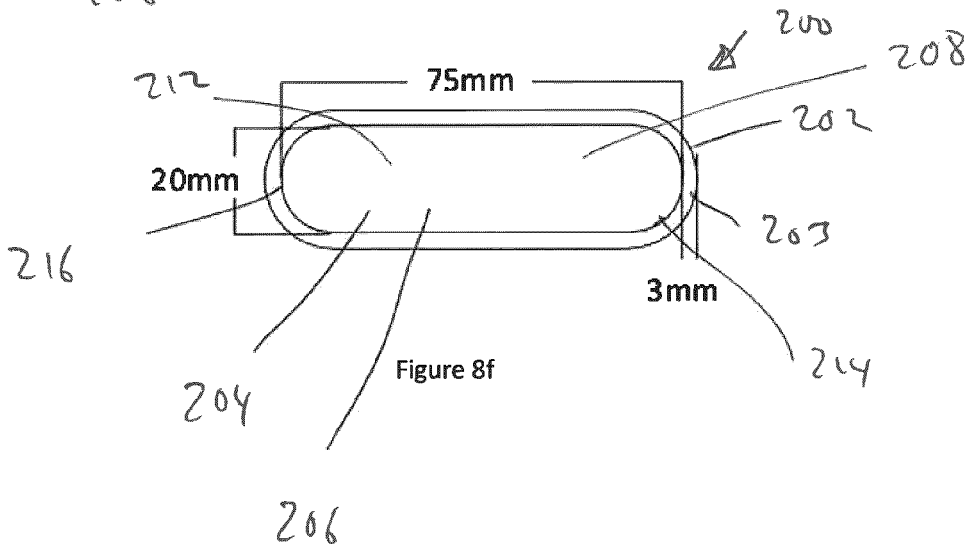
Figure 8G:
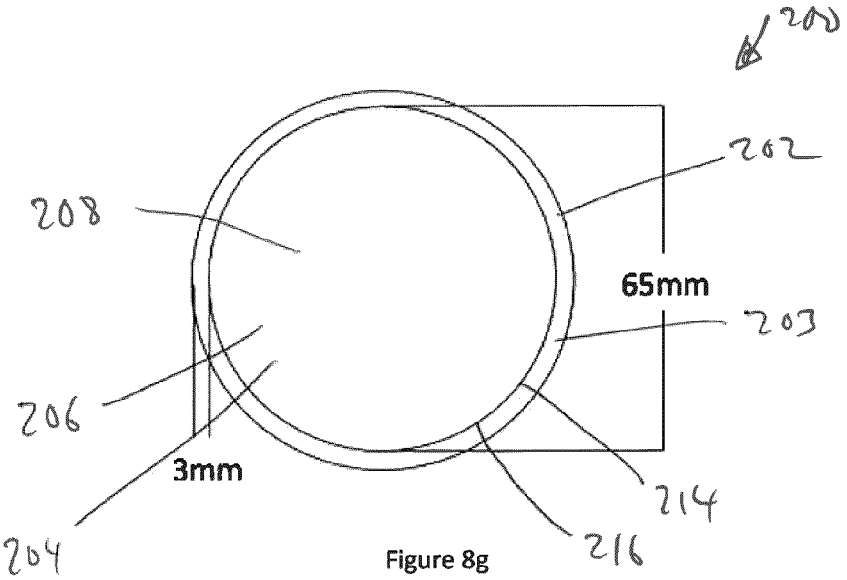
Figure 8H:
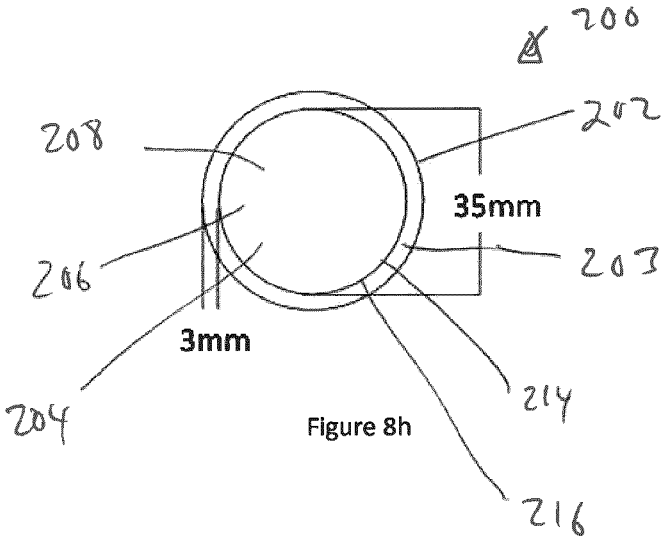

With reference to FIGS. 7*b* and 7*c*, upon impact, force (F) is transmitted from shell 102 towards the user's head 10. This force may arrive at an oblique angle to the surface of shell 102 at the point of impact in a manner which imparts a rotational force to shell 102 as shown in FIG. 7*b* or be directly perpendicular to surface of shell 102 at the point of impact as shown in FIG. 7*c*. In either case, at least some compressive force is applied to cushion 200, which initially compresses pad 206 whilst this is in a saturated state. In this state, pad 206 is somewhat resistant to compression. As pad 206 is compressed, liquid 204 is released from pores 212 into gap 214 where it can flow generally freely. As liquid 204 is released, it forms liquid layer 216 which permits the upper and lower portions of bladder 202 to slip easily relative to each other. In this fashion, liquid 204 is transformed from a trapped, non free-flowing state into a free-flowing state within bladder 202 whereby bladder 202 can easily manage shear forces.

An oblique (i.e. "angled") or rotational force acting on shell 102 generates shear forces on cushion 200. Depending on the direction of the impact, the resulting rotational acceleration imparted to the user's head 10 in a conventional helmet can increase the risk of subdural haematomas or concussions. In the case of helmet 100, cushion 200 attenuates these rotational forces by uncoupling the movement of shell 102 from head 10, which in turn permits shell 102 to rotate relative to the user's head 10. A rotational force on shell 102 generates shearing force acting on cushion 200. Liquid layer 216 generated within cushion 200 following an impact acts as a slip plane which allows opposing upper and lower portions of bladder 202 to be freely displaced relative to each other, effectively allowing cushion 200 to "roll", thereby allowing a degree of rotational freedom of shell 102 relative to the user's head. It will be seen that the degree of "roll" is based in part on the thickness of cushion 200.

Cushion 200 also serves to attenuate linear forces directed radially inwardly towards the center of the user's head 10 by compression of pad 206 and flexibility and distortion of bladder 202 when compressed.

After the initial force of the impact is removed, the resilience of pad 206 causes it to expand back to its pre-impact thickness, which in turn re-absorbs liquid 204 into pad 206, as shown in FIG. 7*a*.

Cushion 200 and pad 206 may comprise a range of configurations, as required for different applications. By way of example, as shown in FIGS. 1 through 4, cushions 200 and pad 206 may be oval, or as shown in FIG. 5, pad 206 may be disc-shaped.

As shown in FIGS. 8*a* to 8*h*, cushions 200 and pad 206 can assume different configuration. For example, cushion 200 can range from about 50 mm to about 150 mm in length and the about 20 mm to about 50 mm in width. The thickness of cushions 200 can based in part on the desired degree of offset. Typically, the thickness of cushions 200 range from about 3 to 5 mm, and more preferably about 4 mm. Typically, pad 206 is about 3 mm to 4 mm, and more preferably about 3 mm. Typically, the wall thickness of the bladder 202 is about 0.5 to 1 mm. Flange 203 can have any dimension suitable for sealing bladder 202 and may be about 3 mm in width.

Suitable dimensions include, for cushion 200 is round may be provided having a diameter of about 65 mm and a height of about 4 mm, a bladder thickness of about 0.5 mm, a flange length of about 3 mm, a foam diameter of about 59 mm and foam thickness of about 4 mm, and a gap distance of about 3 mm. In this example, bladder 202 is filled with about 3.0 ml of vegetable oil. In other examples, cushions 200 is round with a diameter of about 35 mm, a height of about 5 mm, a bladder thickness of about 0.5 mm, a flange length of about 3 mm, a foam diameter of about 29 mm, a foam thickness of about 4 mm, a gap 214 of about 3 mm, and about 1.2 ml of fluid 204.

Dimensions of cushion 200 should be suitable to permit sufficient lateral movement between upper and lower surfaces of bladder 202 to attenuate shear forces to a degree that is effective for the body armour. It will be seen that different uses and applications will require different configurations and dimensions, especially when taking into account additional requirements such as weight limitations and the overall thickness of the helmet or other armour. The configuration of cushion may thus be optimized for any given application.

An advantage of cushion 200 is reduced weight as compared to a similarly dimensioned bladder filled with liquid alone. The present example is estimated to be about half the weight of a bladder having similar dimensions that houses only liquid.

Figure 9:
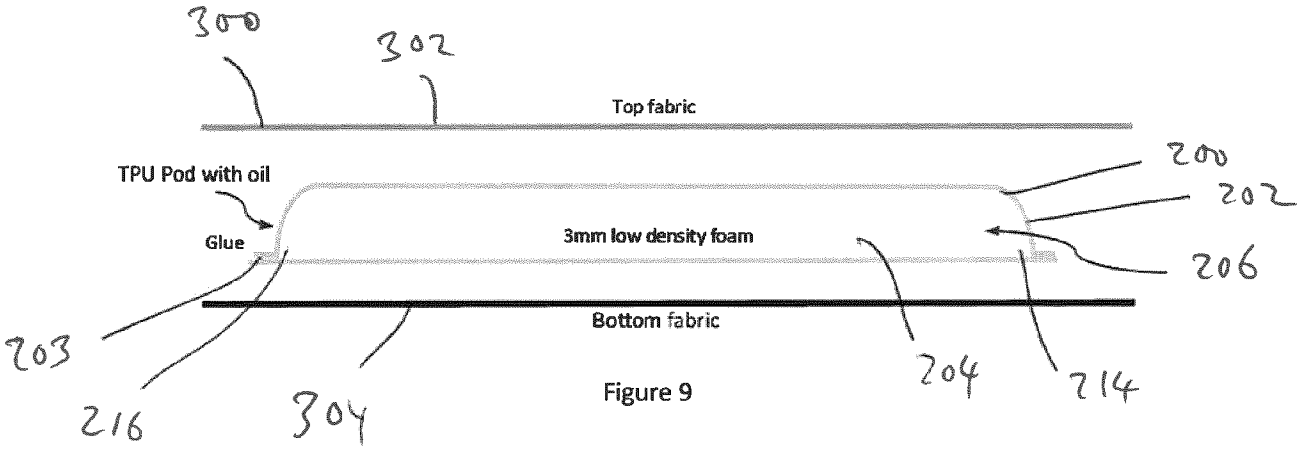
FIG. 9 is an exploded view of a pad, according to another embodiment in which the pad is wrapped with a material.
Figure 10:
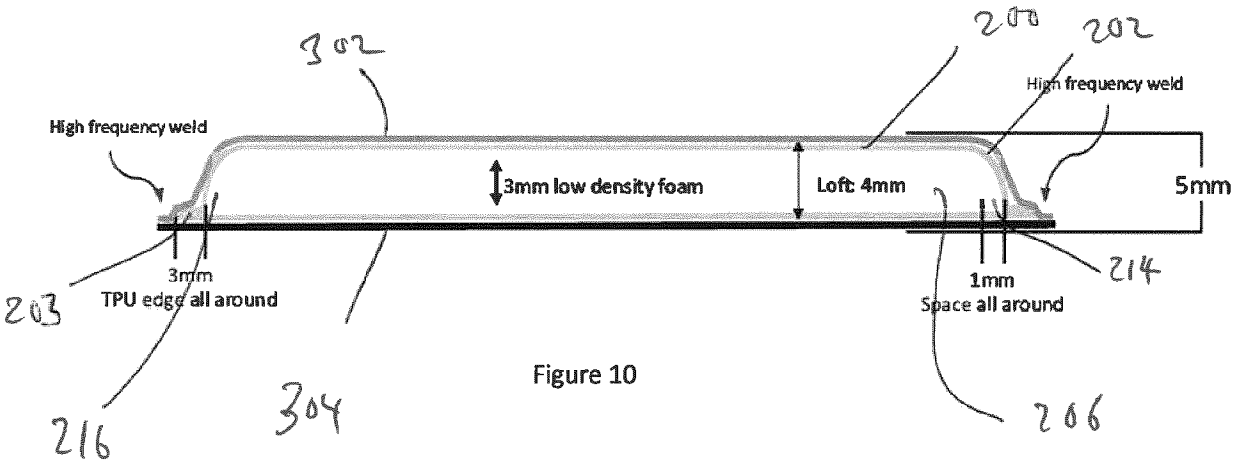
FIG. 10 is a sectional view of the pad of FIG. 9.

Cushion 200 may be covered with material 300 to enhance user comfort, protect bladder 202, improve attachment to other helmet components, etc. As shown in FIGS. 9 and 10, a combination of different fabric materials 302 and 304 may cover cushion 200 and may be fused thereto by high frequency welding or other means. Material 300 can be a natural or synthetic material, such as for example, Nylon, polyester, or spandex.

Figure 11:
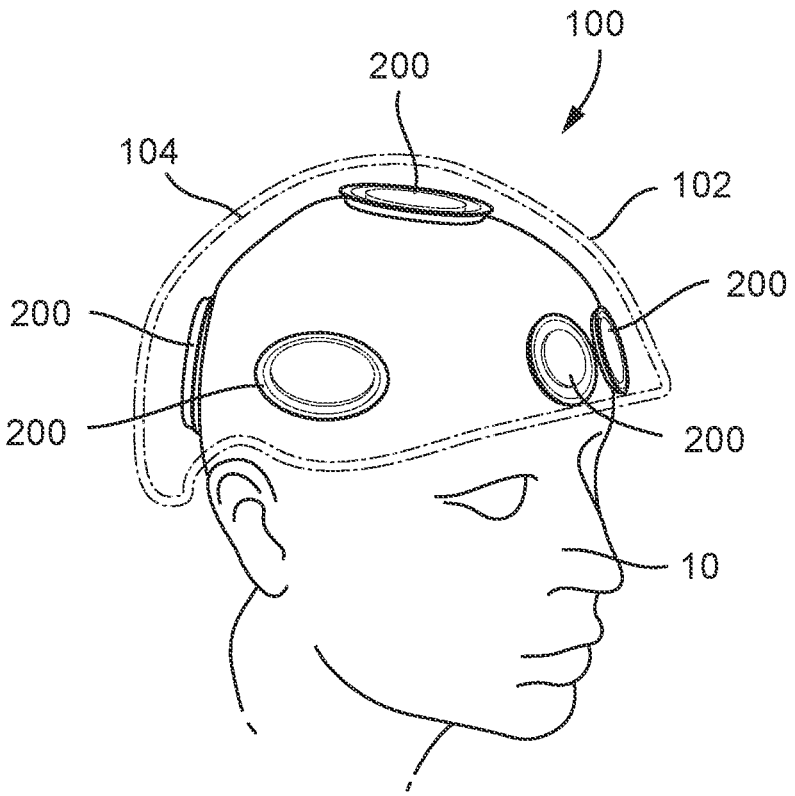
FIG. 11 is a perspective view of a snow sports helmet which is transparent to show internal structure.
Figure 12:
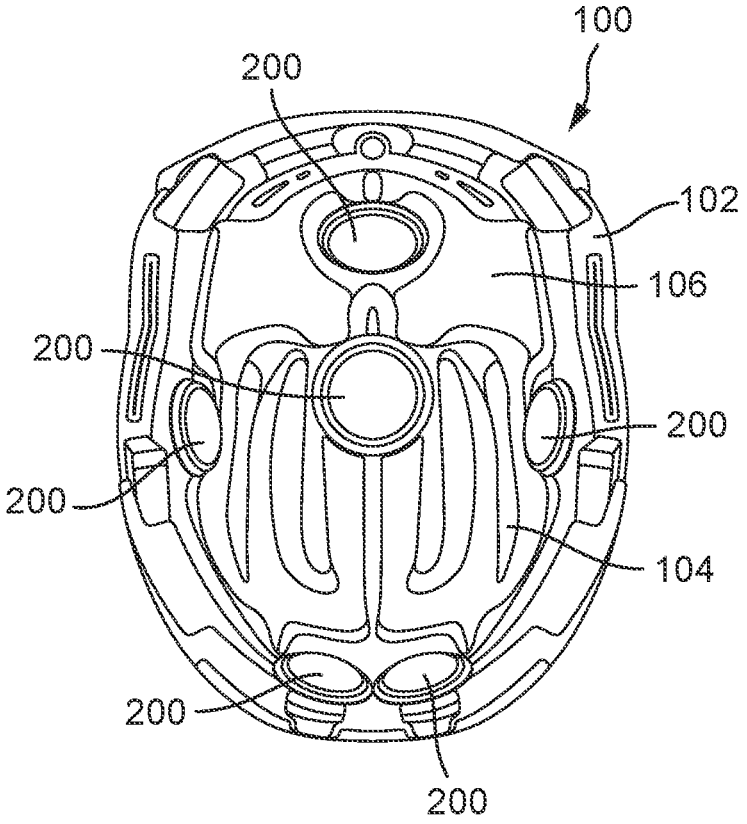
FIG. 12 is a bottom plan view of the snowsports helmet.

Cushions 200 can be configured for use in a variety of body armor devices, including helmets for many activities. The numbers, placement and configurations of cushions 200 will reflect the desired properties of the body armor device. For example, FIGS. 1, 11 and 12 show six cushions 200 in a snow sports helmet 100 distributed around the user's head. Cushions 200 can be fixed or removably secured to liner 104 to contact the user's head either directly or with a thin layer of material covering cushions 200. In this configuration, the slip plane created by the cushion 200 upon impact with an oblique force is located between the user's head and energy absorbing liner 104. The thickness (and other properties) of the cushions 200 can be configured to function seamlessly with any comfort liners 106 that may be secured to the interior of the helmet 100.

Figure 13:
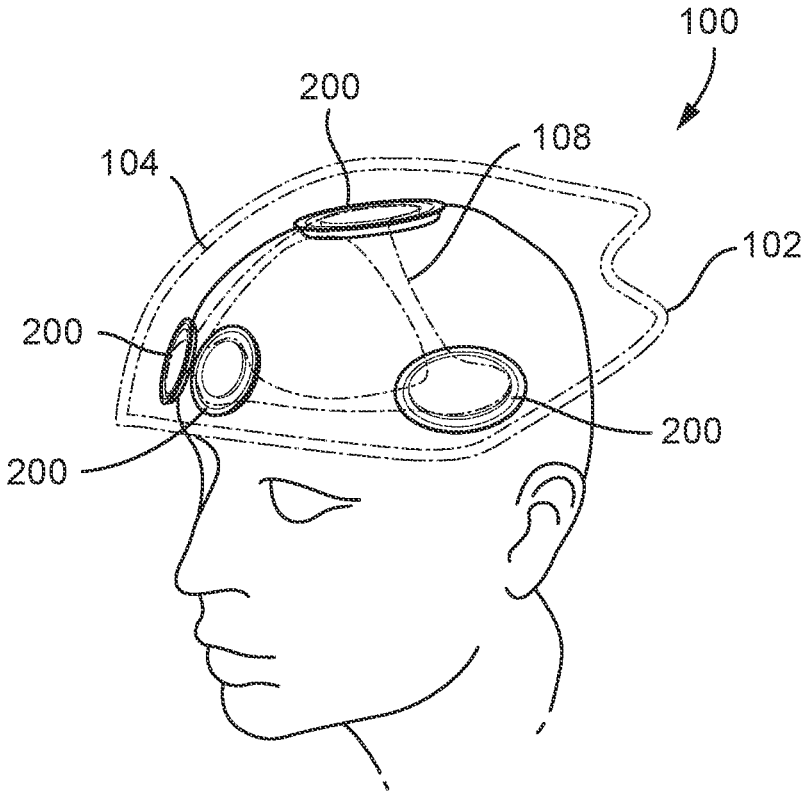
FIG. 13 is a perspective view of a cycling helmet, in which the outer shell is transparent.
Figure 14:
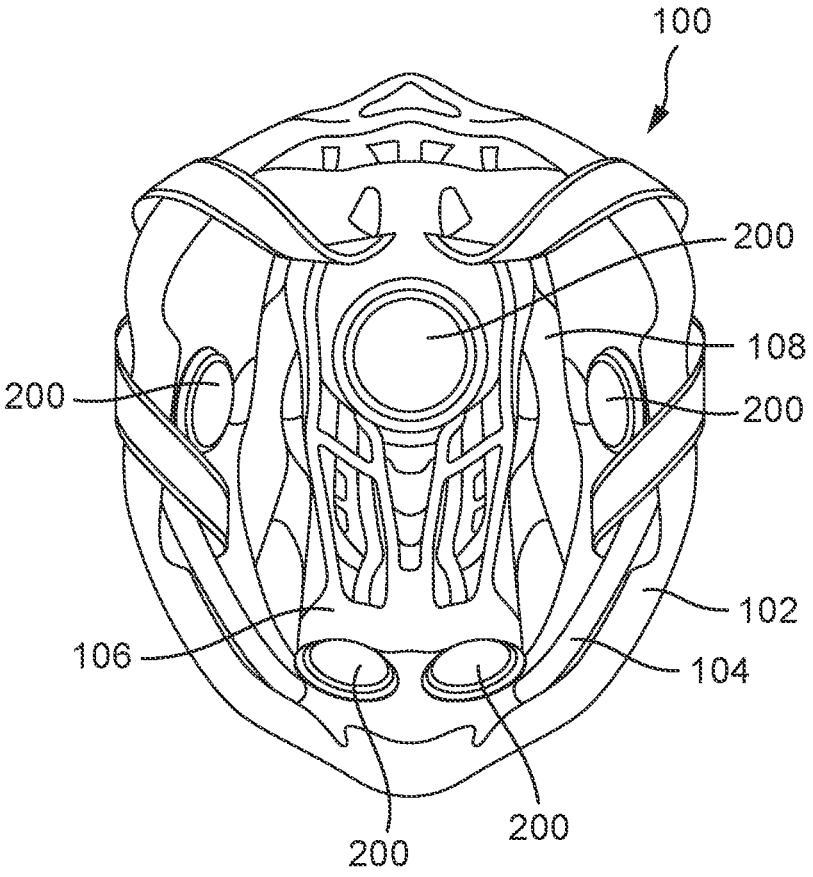
FIG. 14 is a bottom plan view of the cycling helmet.

FIGS. 13 and 14 show the integration of five cushions 200 in a cycling helmet 100. Helmet 100 comprises, from the outside in, an outer shell 102, a crushable rigid foam liner 104, an adjustable skull grip 108 and an array of cushions 200. Cushions 200 are located in an array at the front, rear, sides and top of the helmet. Cushions 200 are attached to the inside surface of skull grip 108, for example by gluing or welding. Cushions 200 contact the user's head either directly or with a thin layer of material interposed (not shown). When an oblique force impacts helmet 100, cushion 200 generates a slip plane between the user's head and skull grip 108. As such, an oblique force is applied to shell 102, which is directly transmitted to liner 104 and skull grip 108. However, this oblique (shear/rotational) force becomes attenuated by cushions 200 thereby lessening these oblique forces against the user's head.

As shown in FIGS. 1 and 11-14, helmet 100 comprises an array of cushions 200 located around the periphery of the skull, such as distributed at the front, rear and sides of the helmet, as well as the top. Alternative configurations may be provided in which cushions 200 serve to maintain a spacing between the user's head and the next-in-line helmet component, such as a skull grip or rigid foam liner.

Table 1 shows the measurements of linear and rotational acceleration at four locations (front, side, rear, and crown) around a conventional helmet and a helmet according to the present invention including four cushions 200 installed on a skull grip 108 with a 6 mm cushion at crown and 4 mm cushions at each side and the front (all with vinyl nitrile foam). In table 1, a helmet according to the present invention provides an average decrease in linear acceleration of about 13.9% and an average decrease of rotational acceleration of about 14.7%, as compared to the conventional helmet.

TABLE 1

| | Linear Acceleration (g) | | | Rotational Acceleration (radians/s2) | |
|---|---|---|---|---|---|
| | regular | Fluid | | regular | Fluid |
| | Technology type | | | Technology type | |
| | baseline | P4 | | baseline | P4 |
| | Helmet # | | | Helmet # | |
| | 1 | 1 | | 1 | 1 |
| | mass (g) | | | mass (g) | |
| | 1387 g | 1452 g | | 1387 g | 1452 g |
| Front | 136.5 | 124.8 | Front | 9919.3 | 8722.6 |
| Side | 95.4 | 88.6 | Side | 7498.2 | 7389.8 |
| Rear | 147.8 | 115.3 | Rear | 4031.9 | 3066.8 |
| Crown | 114.7 | 97.1 | Crown | 8664.1 | 6495.1 |
| Average | 123.6 | 106.45 | Average | 7528.375 | 6418.575 |
| % Difference from RPHA baseline helmet | — | −13.875 | % Difference from RPHA baseline helmet | — | −14.742 |

Table 2 shows the measurements of linear and rotational acceleration at four locations (front, side, rear, and crown) around a conventional helmet and a helmet according to the present invention including two cushions 200 installed on a skull grip with a 6 mm cushion at the crown and a 4 mm cushion at the front (all with vinyl nitrile foam). In table 2, a helmet according to the present invention provides an average decrease in linear acceleration of about 12.3% and an average decrease of rotational acceleration of about 9.4%, as compared to the conventional helmet.

TABLE 2

| | Linear Acceleration (g) | | | Rotational Acceleration (radians/s2) | |
|---|---|---|---|---|---|
| | regular | Fluid | | regular | fluid |
| | Technology type | | | Technology type | |
| | baseline | P3 | | baseline | P3 |
| | Helmet # | | | Helmet # | |
| | 1 | 1 | | 1 | 1 |
| | mass (g) | | | mass (g) | |
| | 1387 g | 1418 g | | 1387 g | 1418 g |
| Front | 136.5 | 118.6 | Front | 9919.3 | 8362.4 |
| Side | 95.4 | 79.7 | Side | 7498.2 | 6815.9 |
| Rear | 147.8 | 136.9 | Rear | 4031.9 | 3724 |

TABLE 2-continued

| | Linear Acceleration (g) | | | Rotational Acceleration (radians/s2) | |
|---|---|---|---|---|---|
| | regular | Fluid | | regular | fluid |
| | Technology type | | | Technology type | |
| | baseline | P3 | | baseline | P3 |
| | Helmet # | | | Helmet # | |
| | 1 | 1 | | 1 | 1 |
| | mass (g) | | | mass (g) | |
| | 1387 g | 1418 g | | 1387 g | 1418 g |
| Crown | 114.7 | 98.3 | Crown | 8664.1 | 8371.2 |
| Average | 123.6 | 108.375 | Average | 7528.375 | 6818.375 |
| % Difference from RPHA baseline helmet | — | −12.318 | % Difference from RPHA baseline helmet | — | −9.431 |

The experimental results of tables 1 and 2 were obtained under testing conditions performed in accordance with CE-1077/1078.

In other embodiments, helmet 100 may also include other components for decreasing and/or redirecting rotational or shear forces such as force redirection cushions 400 of the type disclosed in applicant's PCT application no. PCT/CA2017/050109, which is incorporated by reference in its entirety.

The embodiments described herein are intended merely to provide examples of the invention. Various alterations, modifications and variations to these embodiments may be made without departing from the intended scope of the invention. Features from one or more of the above-described embodiments may be selected to create alternate embodiments comprised of a sub combination of features which may not be explicitly described above. The subject matter described herein intends to cover and embrace all suitable changes in technology.

The invention claimed is:

1. A cushion for managing shear forces in a body armor, the cushion comprising:

a sealed flexible bladder filled with a liquid and containing a compressible and resilient solid element therein, wherein the solid element fills the interior of the bladder when uncompressed, and the solid element is detached from at least an upper or lower surface of the bladder to permit the liquid to flow at least partially around the element.

2. The cushion of claim 1 wherein the liquid is oil.

3. The cushion of claim 1 wherein the solid element has a density that is less than the liquid.

4. The cushion of claim 1 wherein the solid element comprises open cell foam or an open lattice whereby the liquid is configured to be expelled from the element and absorbed into the element when respectively compressed and decompressed.

5. The cushion of claim 1 wherein the solid element comprises a closed cell material.

6. A body armor system comprising an outer impact-receiving layer and at least one cushion according to claim 1 interior to said layer for managing shear forces impacting the outer impact-receiving layer.

7. The system of claim 6 wherein the solid element is detached from at least an upper or lower surface of the bladder.

8. The system of claim 6 wherein the solid element has a density that is less than the liquid.

9. The system of claim 8 wherein the solid element comprises open cell foam or an open lattice whereby the liquid is expelled and absorbed from the element when compressed and decompressed.

10. The system of claim 8 wherein the solid element comprises a closed cell material.

11. The system of claim 6 further comprising an energy absorbing layer between the outer impact-receiving layer and the at least one cushion.

12. The system of claim 11 wherein the energy absorbing layer comprises rigid foam.

13. The system of claim 6 wherein the outer impact-receiving layer comprises a rigid shell.

14. The system of claim 6, further comprising a helmet.

15. The system of claim 14 wherein the helmet further comprises an inner skull grip and the at least one cushion is located between the skull grip and the wearer's head.

16. The system of claim 14, comprising an array of cushions arranged at the front, sides and rear of the helmet.

17. The system of claim 16 wherein the array of cushions comprises at least one cushion at the top of the helmet.

18. The system of claim 6 further comprising at least one force redirection cushion configured for redirecting a force impacting the outer impact-receiving layer in a direction away from the direction which causes the highest risk of injury.

19. A method of decoupling the body of a user from angular or rotational forces impacting on body armor worn by the user, the method comprising use of the system of claim 6.

* * * * *